US007094019B1

(12) United States Patent
Shapiro

(10) Patent No.: US 7,094,019 B1
(45) Date of Patent: Aug. 22, 2006

(54) SYSTEM AND METHOD OF SURGE LIMIT CONTROL FOR TURBO COMPRESSORS

(75) Inventor: Vadim Shapiro, Clive, IA (US)

(73) Assignee: Continuous Control Solutions, Inc., Des Moines, IA (US)

( * ) Notice: Subject to any disclaimer, the term of this patent is extended or adjusted under 35 U.S.C. 154(b) by 0 days.

(21) Appl. No.: 10/847,556

(22) Filed: May 17, 2004

(51) Int. Cl.
*F04D 27/02* (2006.01)
*F04D 27/00* (2006.01)
*F04B 49/00* (2006.01)

(52) U.S. Cl. ..... 415/27; 415/17; 415/26; 417/20; 417/282

(58) Field of Classification Search ..... 60/605.1; 415/27, 17, 1, 26; 417/20, 282, 300
See application file for complete search history.

(56) References Cited

U.S. PATENT DOCUMENTS

| | | | | |
|---|---|---|---|---|
| 4,142,838 A | | 3/1979 | Staroselsky | 417/20 |
| 4,164,033 A | | 8/1979 | Glennon et al. | 415/17 |
| 4,526,513 A | * | 7/1985 | Bogel | 417/20 |
| 4,831,534 A | * | 5/1989 | Blotenberg | 415/15 |
| 4,831,535 A | | 5/1989 | Blotenberg | 415/17 |
| 4,949,276 A | | 8/1990 | Staroselsky et al. | 415/17 |
| 5,195,875 A | | 3/1993 | Gaston | 415/27 |
| 5,306,116 A | * | 4/1994 | Gunn et al. | 415/27 |
| 5,313,779 A | | 5/1994 | Rodgers | 60/787 |
| 5,508,943 A | | 4/1996 | Batson et al. | 415/1 |
| 5,599,161 A | | 2/1997 | Batson | 415/1 |
| 5,709,526 A | | 1/1998 | McLeister et al. | 415/17 |
| 5,726,891 A | | 3/1998 | Sisson et al. | 415/27 |
| 5,743,715 A | * | 4/1998 | Staroselsky et al. | 415/17 |
| 5,798,941 A | * | 8/1998 | McLeister | 415/26 |
| 5,908,462 A | | 6/1999 | Batson | 415/17 |
| 6,503,048 B1 | * | 1/2003 | Mirsky | 415/1 |
| 6,558,113 B1 | * | 5/2003 | Blotenberg | 415/17 |

FOREIGN PATENT DOCUMENTS

EP 500195 A2 * 8/1992

OTHER PUBLICATIONS

"Series 3 Plus Antisurge Controller for Axial and Centrifugal Compressors" Compressor Controls Corporation, PB301 (2.1) Mar. 2000.
"The History of Turbo Compressors" Cashflo for Compressed Air, Southwest Research Institute, Jan. 26, 2004.

* cited by examiner

*Primary Examiner*—Thai-Ba Trieu
(74) *Attorney, Agent, or Firm*—McKee, Voorhees & Sease, P.L.C.

(57) ABSTRACT

A system and method of surge limit control for turbo compressors including a turbo compressor having an inlet and an outlet, an anti-surge valve, a variable speed drive to operate the compressor, a rotational speed transmitter, an inlet temperature transmitter, an inlet pressure transmitter, an outlet pressure transmitter and/or guide vanes, and a controller, the controller including a PID control module wherein the computer uses information from the transmitters to continuously calculate a pressure ratio of the compressor at the compressor's current operational speed and compare it to the compressor's calculated pressure ratio at surge limit conditions. A computer generates a control signal for determining when to open the anti-surge valve if the pressure ratio of the compressor at the compressor's current operational speed guide vanes are within a user defined safety margin to the calculated pressure ratio at surge limit conditions.

3 Claims, 7 Drawing Sheets

| TS | n=1.1 eff=.9 | n=1.1 eff=.8 | n=1.1 eff=.7 | n=1.2 eff=.9 | n=1.2 eff=.8 | n=1.2 eff=.7 | n=1.3 eff=.8 | n=1.3 eff=.8 |
|---|---|---|---|---|---|---|---|---|
| 310 | 1.90939009 | 1.910037576 | 1.91086164 | 1.906987 | 1.907352 | 1.907819 | 1.912234919 | 1.907352 |
| 305 | 1.92854777 | 1.929068442 | 1.92973084 | 1.926613 | 1.926908 | 1.927284 | 1.930834019 | 1.926908 |
| 300 | 1.94850829 | 1.948891056 | 1.9493778 | 1.947085 | 1.947302 | 1.947579 | 1.950187943 | 1.947302 |
| 295 | 1.9693221 | 1.969554821 | 1.96985063 | 1.968456 | 1.968588 | 1.968756 | 1.970342655 | 1.968588 |
| 290 | 1.99104391 | 1.991113265 | 1.99120139 | 1.990786 | 1.990825 | 1.990875 | 1.991347865 | 1.990825 |
| 285 | 2.01373309 | 2.013624474 | 2.01348653 | 2.014138 | 2.014076 | 2.013997 | 2.013257413 | 2.014076 |
| 280 | 2.03745426 | 2.037151581 | 2.03676739 | 2.038584 | 2.038412 | 2.038192 | 2.036129704 | 2.038412 |
| 275 | 2.06227777 | 2.061763316 | 2.06111066 | 2.0642 | 2.063907 | 2.063532 | 2.060028188 | 2.063907 |
| 270 | 2.08828039 | 2.087534633 | 2.08658903 | 2.09107 | 2.090644 | 2.0901 | 2.085021916 | 2.090644 |
| 265 | 2.11554607 | 2.114547415 | 2.11328184 | 2.119287 | 2.118714 | 2.117985 | 2.111186159 | 2.118714 |
| 260 | 2.14416675 | 2.142891286 | 2.14127585 | 2.14895 | 2.148218 | 2.147284 | 2.138603113 | 2.148218 |

FIG. 6

SYSTEM AND METHOD OF SURGE LIMIT CONTROL FOR TURBO COMPRESSORS

FIELD OF THE INVENTION

The present invention relates to a method of controlling turbo compressors, and more particularly to a new and useful method of efficiently and effectively controlling turbo compressors in a manner that minimizes the risks of turbo compressors reaching their surge limit.

BACKGROUND OF THE INVENTION

Unstable flow conditions within a turbo compressor can arise from any number of changing process conditions. When this occurs and reduces the flow of gasses with an increase in the specific mechanical energy (polytrophic) of the gas stream, the turbo compressor may surge. Surging can significantly damage a turbo compressor and therefore, control systems have been developed to monitor a turbo compressor's performance.

Should the performance levels drop to a potential surge situation, the control systems must open an anti-surge valve to recycle or blow off an additional portion of the gas flow. If recycling occurs too extensively, it will have an adverse impact on the overall efficiency of the turbo compressor. If recycling is not properly controlled, there may be inadequate protection against surge and the potential damage it may cause to the turbo compressor. There is therefore a need to effectively and efficiently monitor the turbo compressor's operating conditions and evaluate their proximity to the surge conditions. The allowable proximity is commonly known as the safety margin with surge producing operational parameters commonly known as the turbo compressor's surge limit.

A compressor's surge limit, displayed in coordinates of the reduced flow rate ($Q_r$) and the reduced head ($H_r$) is often very difficult to accurately characterize. This difficulty arises from the quality of current compressor flow measurement methods. The level of difficulty increases further when multistage compressors and compressors with side streams are employed. There is therefore a need to develop a method of controlling the compressor to prevent the compressor from reaching its surge limit that does not rely upon measurements of a reduced flow rate or correspondingly, measurements of the compressor's power.

There is therefore a need for a method of controlling a turbo compressor to avoid surge limit conditions which avoids these and other problems.

FEATURES OF THE INVENTION

A general feature of the present invention is the provision of a method of controlling a turbo compressor to avoid surge limit conditions which overcomes the problems found in the prior art.

Another feature of the present invention is the provision of a method of controlling a turbo compressor to avoid surge limit conditions which does not rely upon measurements of the compressor's flow rate.

A further feature of the present invention is the provision of a method of controlling a turbo compressor to avoid surge limit conditions which does not rely upon measurements of the compressor's power.

A still further feature of the present invention is the provision of a method of controlling a turbo compressor to avoid surge limit conditions which does not require expensive and numerous flow measuring tools.

Another feature of the present invention is the provision of a method of controlling a turbo compressor to avoid surge limit conditions which may be used in multistage compressors and compressors with side streams.

These, as well as other features and advantages of the present invention, will become apparent from the following specification and claims.

SUMMARY OF THE INVENTION

The present invention generally comprises a method of measuring the proximity of the compressor's operational conditions to the compressor's surge limit by continuously monitoring the compressor's rotational speed and/or guide vane position, inlet pressure, outlet pressure and inlet temperature.

The present invention has been described in detail for use with turbo compressors having constant gas composition control systems that minimizes the recurrence of surge events. However, the present invention can be practiced for turbo compressor's with variable gas composition, when a software gas composition sensor or an online gas analyzer is available.

Moreover, the present invention offers the user a way to control the anti-surge valve by providing a closed proportional-integral-derivative (PID) loop that monitors the compressor's current pressure ratio and compares the same to the compressor's pressure ratio at surge limit conditions. The anti-surge valve is opened when the compressor's pressure ratio falls within a predetermined safety margin. The suggested size of the safety margin is approximately 3% to 5% of the total span of the compressor's pressure ratio and covers approximately 1% of any setting of the polytrophic exponent.

BRIEF DESCRIPTION OF THE DRAWINGS

FIG. 6 is a table of typical results of the calculation of the pressure ratio at surge limit conditions based on a surge test where the pressure ratio of the surge limit as experimentally determined is 2 and the current suction temperature is 288 degrees Kelvin.

DETAILED DESCRIPTION OF THE PREFERRED EMBODIMENT

The present invention will be described as it applies to its preferred embodiment. It is not intended that the present invention be limited to the described embodiment. It is intended that the invention cover all modifications and alternatives which may be included within the spirit and scope of the invention.

Figure 1:
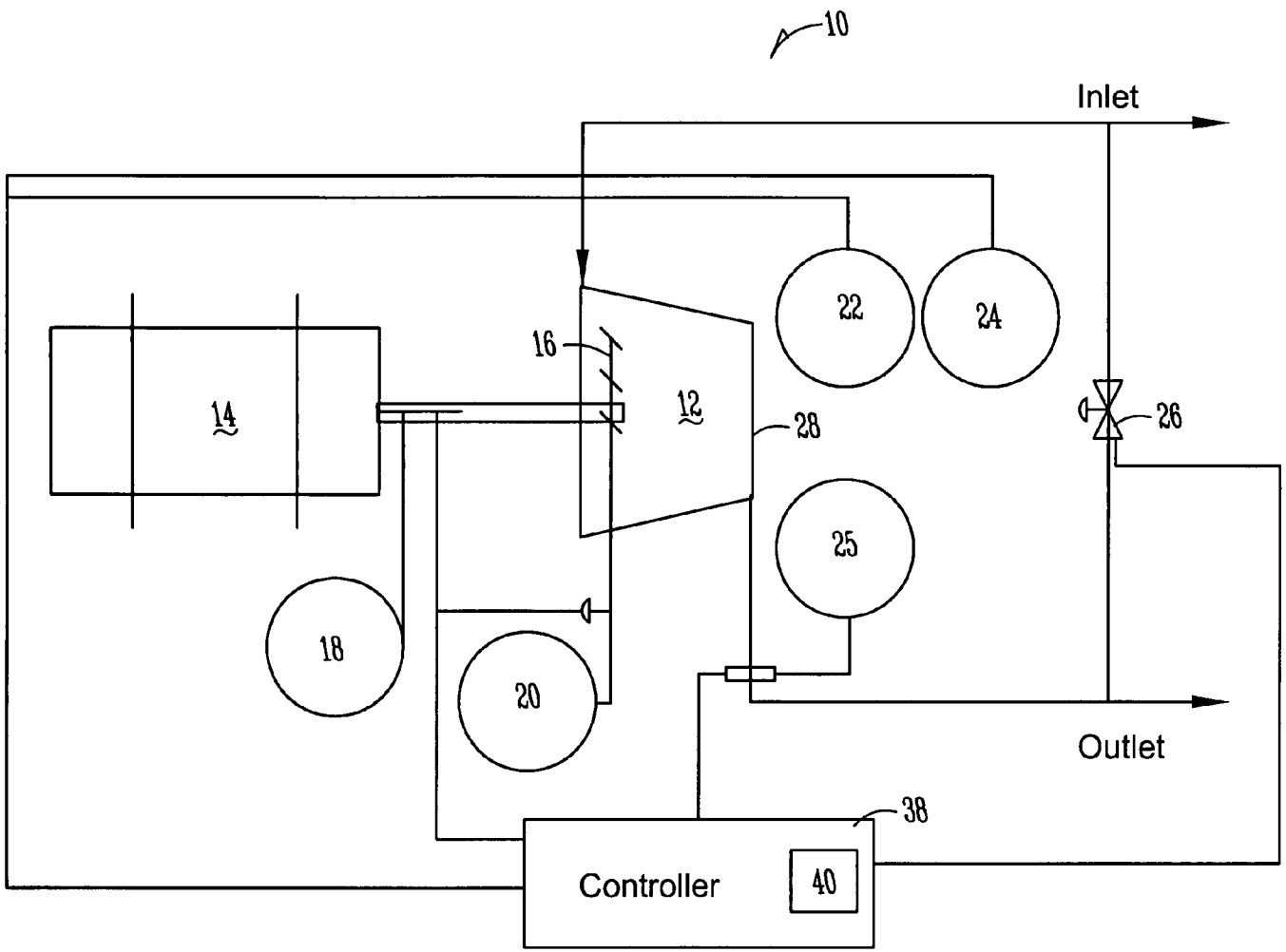
FIG. 1 is a block diagram showing a general turbo compressor with a variable speed drive and guide vanes according to one embodiment of the present invention.

Now, referring to the drawings, FIG. 1 shows a typical turbo compressor system 10 according to the present invention which usually includes a turbo compressor 12, a variable speed drive 14 and guide vanes 16. The operating conditions of the turbo compressor 12 are preferably monitored using a rotational speed transmitter 18, a guide vane position transmitter 20, an inlet pressure transmitter 22, an inlet temperature transmitter 24 and an outlet pressure transmitter 25. To prevent the compressor 12 from surging, an anti-surge valve 26 is connected to the output 28 of the compressor 12.

Figure 2:
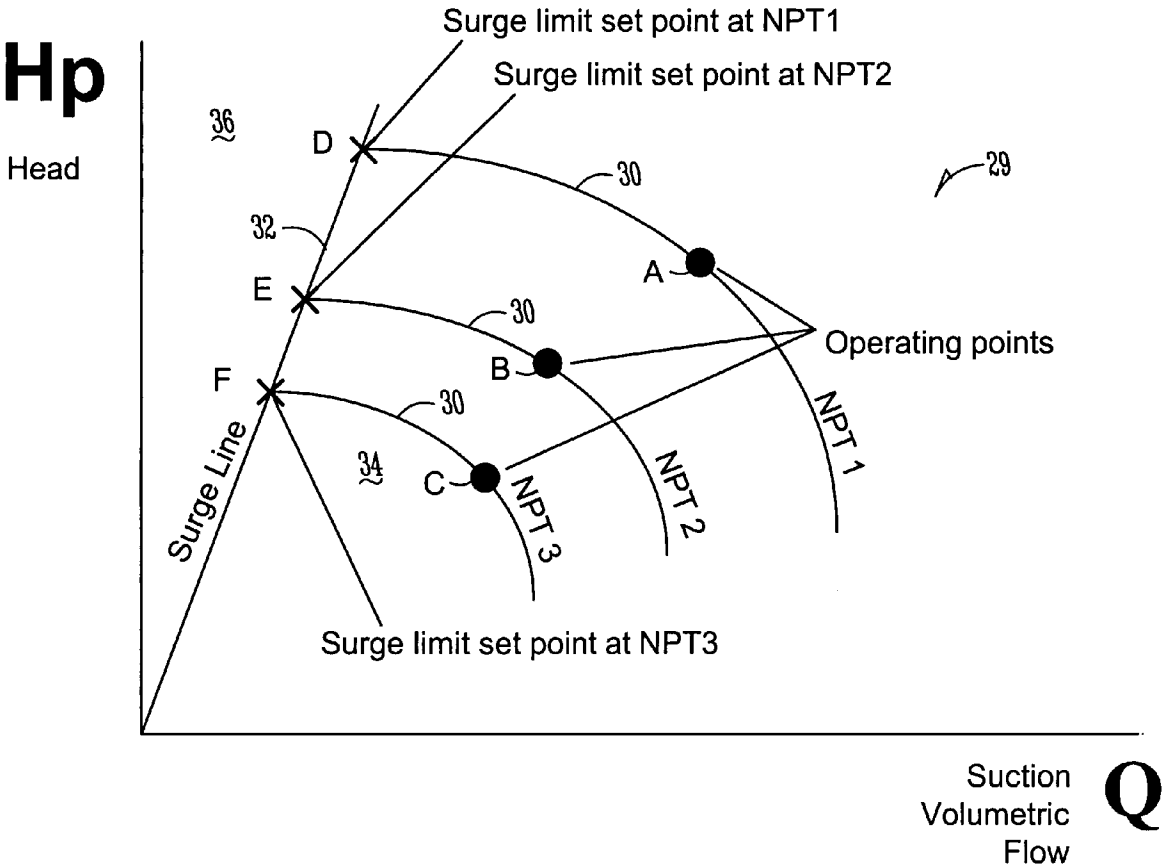
FIG. 2 is a typical compressor map with coordinates provided in terms of polytrophic head vs. suction volumetric flow.

As is shown in FIG. 2, a typical compressor will be provided with a compressor map 29 that includes a plurality of performance curves 30 for different speeds. The user can determine the operating points A, B, and C. The surge dividing line 32 is shown. The surge line 32 divides a stable operating region 34 from the region where surge can occur 36. To protect a compressor 12 from surge conditions, it must be known at what point surge occurs for each rotational speed. These points are shown as D, E and F.

It is well understood that dynamic compression is achieved by increasing the specific mechanical energy (polytrophic head) of the gas stream. The increase in polytrophic head can be calculated based on information gathered from the rotational speed transmitter 18, the guide vane position transmitter 20, the inlet pressure transmitter 22, outlet pressure transmitter 25 and the inlet temperature transmitter 24. Using such data, as is shown in FIG. 1, the surge prevention controller 38 continuously uses a closed loop PID module 40, as is well known in the art, to control the operating point of the compressor 12 and maintain it below the pressure ratio at surge limit conditions ($R_{cs}$) which is set for the current speed of the compressor 12. The process variable of the PID control module 40 is the current pressure ratio ($R_c$). The PID loop generates a control signal for determining when to open the anti-surge valve 26. As is well known, opening the anti-surge valve 26 increases the compressor flow rate by recycling or blowing off an additional stream of process gas.

As is well known in the art, a typical surge prevention controller 38 including a PID control module 40 can calculate the increase in polytrophic head ($H_p$) according to equation 1 as follows:

$$H_p = B * \frac{R_c^{\sigma} - 1}{\sigma} * T_s * \frac{Z_{av}}{MW} \tag{1}$$

Where B is a proportionality constant, $R_c$ is the pressure ratio, σ is the polytrophic exponent, $T_s$ is the suction or inlet temperature, MW is the molecular weight of the current flow and $Z_{av}$ is the average compressibility factor.

The value of the pressure ratio at surge limit conditions ($R_{cst}$) can be experimentally determined as a function of rational speed and/or guide vane positions by performing compressor surge tests. Otherwise, $R_{cst}$ can be calculated mathematically based on the theoretical compressor map typically provided by the compressor manufacturer.

Determining the polytrophic head at surge limit conditions ($H_{ps}$) as a function of rotational speed and/or guide vane positions for the current suction or inlet temperature ($T_{sst}$) may be done according to equation 2 as follows:

$$H_{ps} = B * \frac{R_{cst}^{\sigma} - 1}{\sigma} * T_{sst} * \frac{Z_{av}}{MW} \tag{2}$$

For a constant gas composition at any given rotational speed and/or guide vane position, and assuming the compressibility effects are negligible:

$$H_{ps} = K*(R_{cst}^{\sigma} - 1)*T_{sst} \tag{3}$$

This means that the value of the pressure ratio at surge limit conditions ($R_{cs}$) for different suction temperatures ($T_{ss}$) for any rotational speed can be calculated according to equation 4 as follows:

$$R_{cs} = \left[\left(\frac{T_{sst}}{T_{ss}} * (R_{cst}^{\sigma} - 1)\right) + 1\right]^{\frac{1}{\sigma}} \tag{4}$$

Note that the modified parameter equation 4 differs from the standard approach version of the invariant coordinates by the inclusion of suction temperature or inlet temperature compensation factor $$\frac{T_{sst}}{T_{ss}}.$$

The polytrophic exponent (σ) cannot be measured. Instead, this variable has to be determined in accordance to current gas composition and compressor efficiency, so the polytrophic exponent (σ) has to be assumed in case of an inaccurate setting of the polytrophic exponent (σ), which would lead to the incorrect calculation of the surge limit set point.

Figure 7:
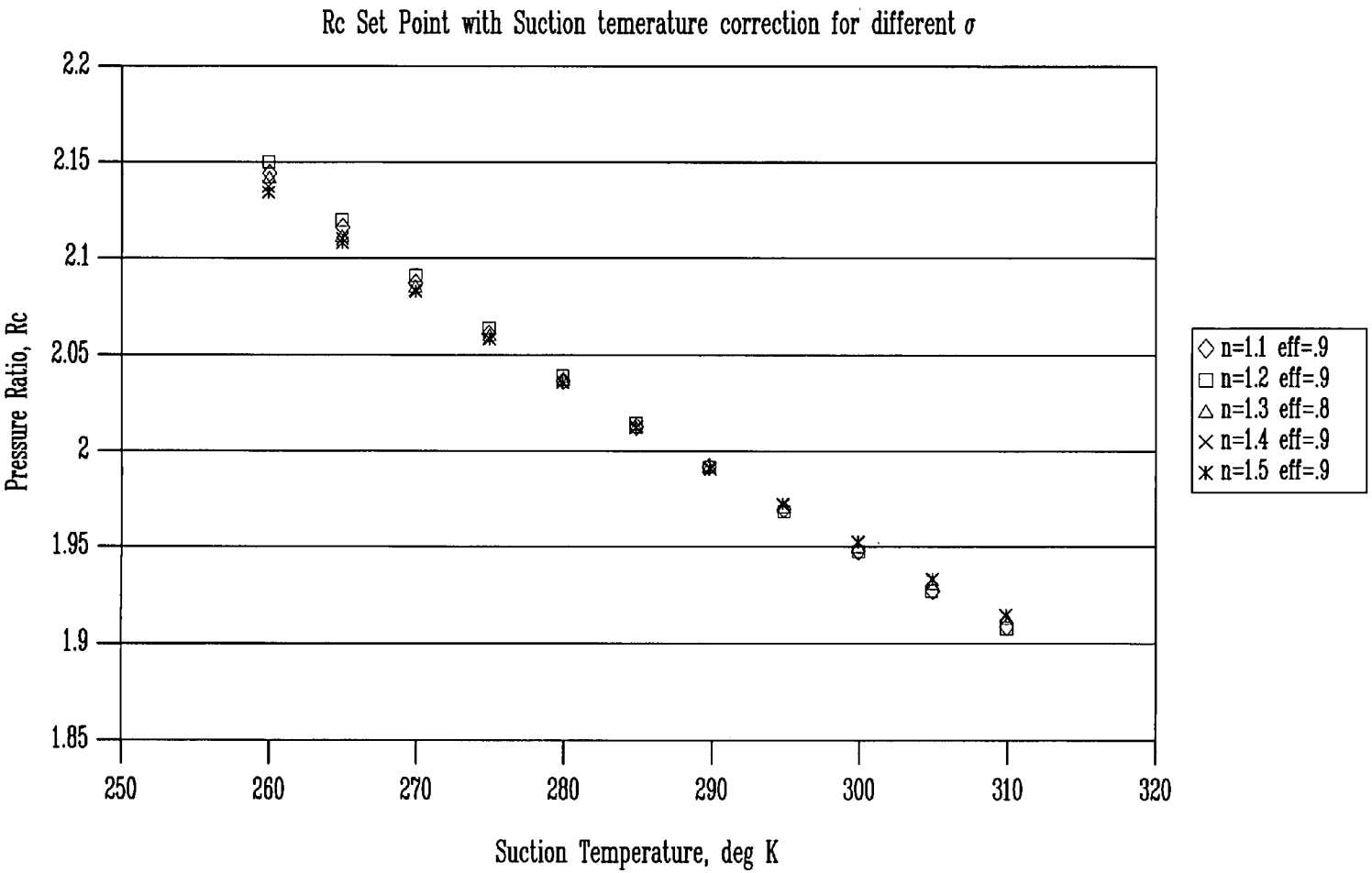
FIG. 7 is the XY plot of the Table 1 (FIG. 6) calculation results.

As shown in FIG. 6, Table 1 demonstrates the results of $R_{cs}$ calculations (equation 3) for a surge test where $R_{cst}$=2 and $T_{sst}$=288 degrees K. The first column represents the variation of compressor suction pressure. Each following column represents the variation of the compressor efficiency and gas composition for the surge limit point. FIG. 7 is the XY plot of the Table 1 calculation results. As shown, the temperature compensation line has a negative slope, in other words, the increasing of suction temperature causes a decreasing value of the surge limit pressure ratio set point. It can be observed that variations in efficiency and gas composition affect the compensation coefficient within a range of 1% ($R_c$ span).

When the surge prevention controller 38 using the closed loop PID module 40, as is well known in the art, determines the current pressure ratio $R_c$ of the compressor 12 is within the safety margin 44 of the calculated pressure ratio at surge limit conditions ($R_{cs}$) (points D, E, and F) which is set for the current speed of the compressor 12, the anti-surge valve 26 may be employed thus minimizing the risk that the compressor 12 will experience surge conditions while simultaneously optimizing the efficiency of the compressor 12.

Figure 3:
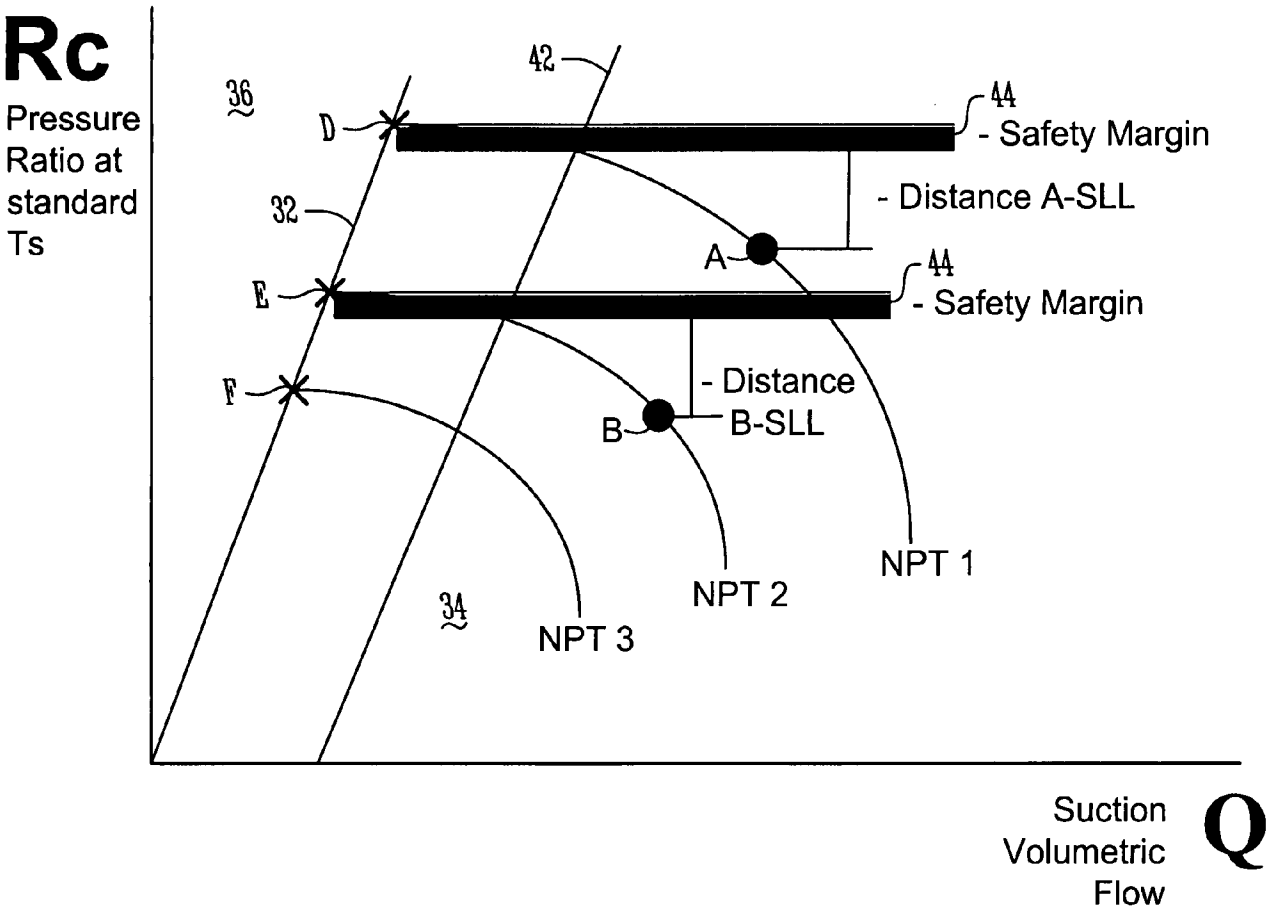
FIG. 3 is a graph of a typical compressor's surge limit lines with corresponding safety margins for the turbo compressor in pressure ratio v. suction volumetric flow coordinates.

As shown in FIG. 3, a user specified surge limit line 42 is positioned in the stable operating region 34 and displaced down from the actual surge limit line 32 by the user specified safety margin 44. It is preferred that the safety margin 44 be between approximately 3% and 5% of the pressure ratio ($R_c$) span.

Figure 4:
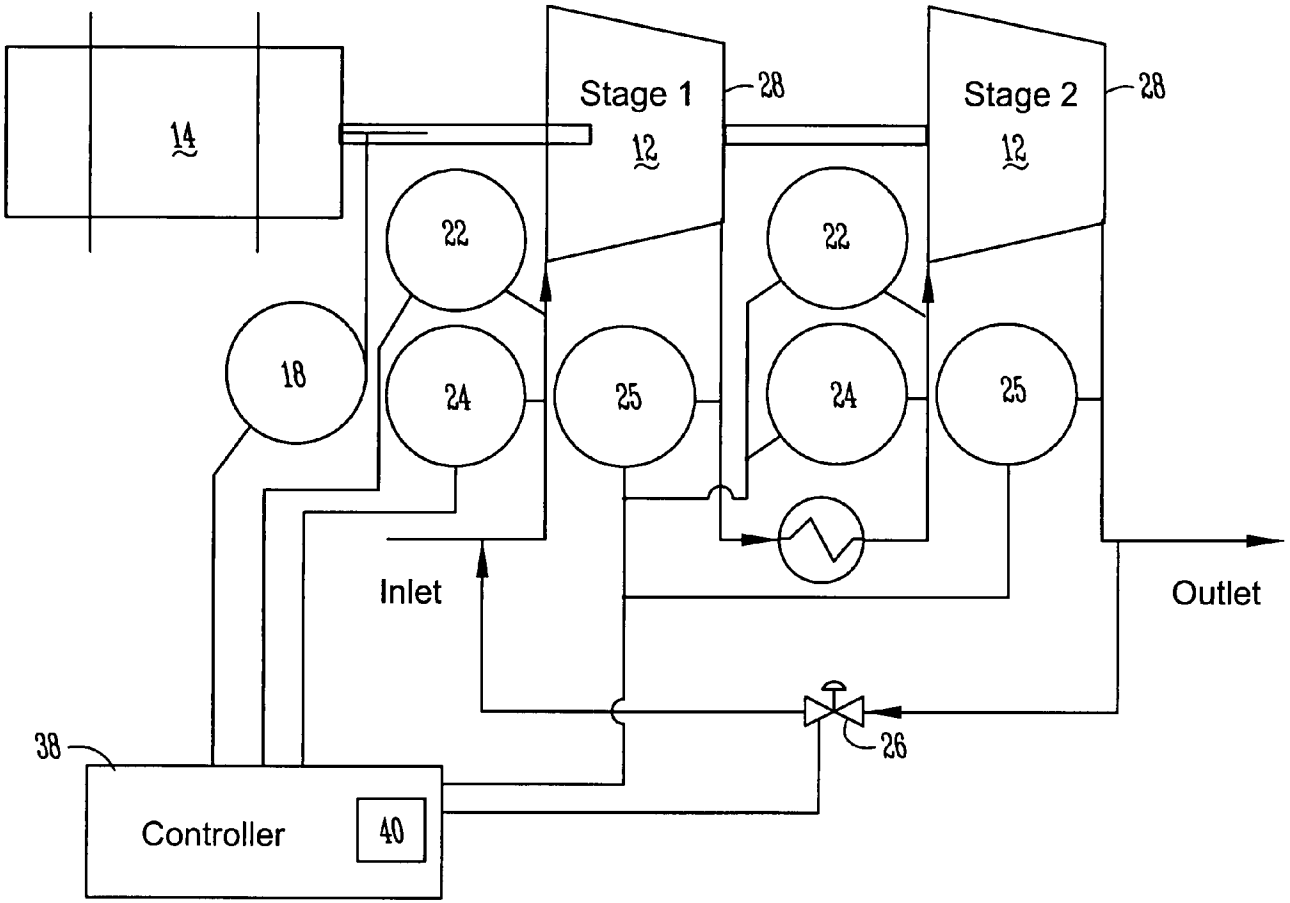
FIG. 4 is a block diagram showing a multistage turbo compressor with a variable speed drive according to one embodiment of the present invention.
Figure 5:
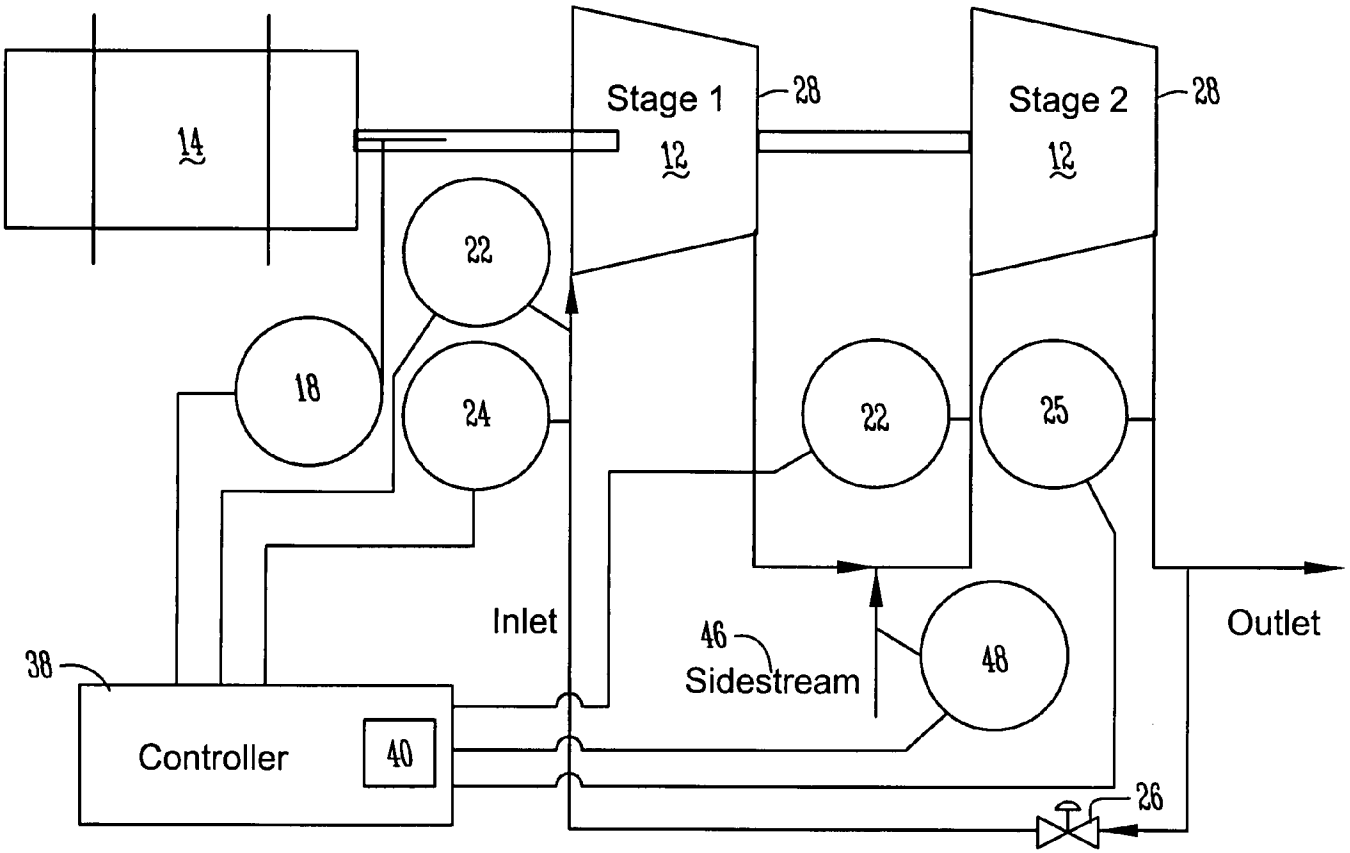
FIG. 5 is a block diagram showing a turbo compressor with variable speed drive and a side stream according to one embodiment of the present invention.

Though the new techniques described above are applicable to axial and centrifugal compressors, the method also allows a user to more accurately calculate the proximity of the compressor's operating point to surge conditions because the compressor's flow and/or power measurements are not required. Such a system is especially effective for surge prevention controllers of multistage compressors, as shown in FIG. 4 and compressors with side streams 46, with a side stream pressure measuring device 48 included as shown in FIG. 5, where not all of the necessary flow measuring devices are available.

What is claimed is:

1. A unique method of anti-surge protection for turbo compressor systems, the method comprising:

monitoring a compressor rotational speed or guide vanes position;

monitoring a compressor inlet temperature;

monitoring a compressor inlet pressure;

monitoring a compressor outlet pressure;

calculating a compressor pressure ratio at surge limit conditions for the current inlet temperature, wherein a compressor ratio is based upon a ratio of the current inlet temperature to the given inlet temperature associated with the pressure ratio at the surge limit conditions and the pressure ratio at the surge limit conditions for the given temperature:

calculating a compressor pressure ratio at current operating conditions;

comparing the compressor pressure ratio at the current operating conditions to the compressor pressure ratio at the surge limit conditions; and opening an anti-surge valve when the comperssor pressure ratio at the current operating conditions approaches a pre-determined safety margin within the compressor pressure ratio at the surge limit conditions to minimize the possibility that the turbo-compressor would experience a surge.

2. The method of anti-surge protection for turbo compressor systems of claim 1 further comprising:

continuously monitoring the compressor pressure ratio at the current operating conditions.

3. A system for anti-surge protection with turbo compressors, the system comprising:

a turbo compressor having an inlet and an outlet;

an anti-surge valve that controls the flow of gasses from the compressor outlet to the compressor inlet;

a variable speed drive to operate the compressor;

a rotational speed transmitter or guide vanes position transmitter;

an inlet temperature transmitter;

an inlet pressure transmitter;

an outlet pressure transmitter; and a controller, the controller including a PID control module;

wherein a computer is programmed to determine a pressure ratio and a current inlet temperature of the compressor at the compressor's current operational speed; and wherein the computer is programmed not to measure a flow rate for purposes of determining the pressure ratio of the compressor at the current operating condition being too close a determined pressure ratio at surge limit conditions to determine when to open the anti-surge valve.

* * * * *